US007493668B2

(12) United States Patent
Piraino

(10) Patent No.: US 7,493,668 B2
(45) Date of Patent: Feb. 24, 2009

(54) BED MATTRESS

(76) Inventor: Mario Piraino, 5 Nolan Close, East Doncaster, Victoria 3109 (AU)

( * ) Notice: Subject to any disclaimer, the term of this patent is extended or adjusted under 35 U.S.C. 154(b) by 0 days.

(21) Appl. No.: 10/344,348

(22) PCT Filed: Aug. 23, 2001

(86) PCT No.: PCT/AU01/01047

§ 371 (c)(1),
(2), (4) Date: Jul. 10, 2003

(87) PCT Pub. No.: WO02/15751

PCT Pub. Date: Feb. 28, 2002

(65) Prior Publication Data

US 2004/0010855 A1 Jan. 22, 2004

(30) Foreign Application Priority Data

Aug. 23, 2000 (AU) ..... PQ9613
May 22, 2001 (AU) ..... PR5154

(51) Int. Cl.
*A47C 27/15* (2006.01)

(52) U.S. Cl. ..... 5/738; 5/727; 5/720

(58) Field of Classification Search ..... 5/737, 5/738, 727–728, 716, 720
See application file for complete search history.

(56) References Cited

U.S. PATENT DOCUMENTS

| | | | | | |
|---|---|---|---|---|---|
| 853,049 | A | * | 5/1907 | Weston | 5/738 |
| 1,914,661 | A | * | 6/1933 | Burke | 5/722 |
| 3,298,363 | A | | 1/1967 | Parkin | |
| 3,339,214 | A | | 9/1967 | Janapol | |
| 3,340,548 | A | | 9/1967 | Janapol | |
| 3,534,417 | A | * | 10/1970 | Boyles | 5/728 |
| 4,389,743 | A | * | 6/1983 | Callaway | 5/720 |
| 5,048,167 | A | * | 9/1991 | Heffley et al. | 29/91.1 |
| 5,081,728 | A | * | 1/1992 | Skinner | 5/727 |
| 5,109,558 | A | | 5/1992 | Di Blasi | |
| 5,136,740 | A | * | 8/1992 | Kraft | 5/730 |
| 6,061,856 | A | | 5/2000 | Hoffmann | |

FOREIGN PATENT DOCUMENTS

| | | |
|---|---|---|
| CH | 659180 | 1/1987 |
| DE | 4 442 719 | 12/1995 |
| DE | 19700132 | 7/1998 |
| EP | 0 103 807 | 3/1984 |
| EP | 0 337 828 | 10/1989 |
| EP | 0 374 742 | 6/1990 |
| FR | 2 662 063 | 11/1991 |
| GB | 2117234 | 1/1985 |

* cited by examiner

*Primary Examiner*—Fredrick Conley
(74) *Attorney, Agent, or Firm*—Husch Blackwell Sanders Welsh & Katz

(57) ABSTRACT

A bed mattress including an outer casing adapted to house one or a plurality of different supportive materials within said casing (1) in distinct transverse regions wherein fixed supportive materials (7, 9, 11) are provided at the top and bottom regions of said mattress corresponding to the head and foot regions of a user; and an intermediate region so formed between is provided with a transverse assay of fixed supportive materials (11) having vacant regions between adjacent materials, wherein said outer casing has a plurality of ports (4) corresponding to said vacant regions which are adapted to facilitate the ready insertion, removal and/or replacement of one or more auxiliary supportive materials (10) so as to allow the user to vary the supportive quality of said intermediate region of said mattress.

6 Claims, 4 Drawing Sheets

BED MATTRESS

BACKGROUND OF THE INVENTION

Bedding mattresses are available in a wide range of types and configurations offering a variety of support conditions for the user.

A principal object of a bed mattress is to provide optimal support for the user commensurate with their physical and medical requirements. Such optimal support requires the mattress to conform substantially to the shape of the users body when resting on the mattress. Unfortunately, most available mattresses react proportionally to the weight distribution of the users body, compressing most where the body is heaviest and least where the body is lightest. This results in mattress conformation which does not reflect the actual physical shape of the users body, but rather reflects a shape imposed on the mattress by the weight distribution of the body. Accordingly, the users body adopts a shape which results from the weight distribution of body segments which does not reflect the actual body shape when resting on a standard mattress. The users skeleton is then twisted and distorted to fit the shape of the mattress as it has reacted to the users weight distribution.

The areas of greatest distortion are the shoulder and lumbar/hip regions. The shoulders are usually the widest part of the human body but occur at the lightest region of the torso. Accordingly the shoulders, when a user is resting on their side, do not push a mattress down much in accordance with the body shape resulting in a degree of twisting of the body when the user is sleeping on their side. In contrast to the shoulder and upper torso region, the hips and lumbar region of the torso are generally much heavier and this region of the users body will compress that part of a mattress disproportionately. In standard mattresses of uniform stiffness this results in the pelvis region being the lowest supported part of the body. Furthermore, the close proximity of the hip region to the waist region of the user tends to deprive the waist, and important lumbar region, of the user with adequate support as the mattress is highly compressed at the hip region and the adjoining area of the mattress leading into the lumbar region is also compressed where it should actually be providing support.

In order to provide optimal support a bed mattress should be able to react independently to the different regions of the users body and at least able to provide dedicated support for the upper, middle and lower torso regions which all have quite distinct weight distribution and support requirements.

An analysis of these three regions designated Region "C" for upper torso; Region "B" for middle torso; and Region "P" for lower torso, highlights the different requirements needed to provide optimal support.

Given that the weight of the lower torso (pelvis region "P") Wp is about 130% of the weight of the middle torso (Belly region "B") Wb; and the weight of the upper torso (chest region "C") Wc is about 50% of the weight of Wb.

Then $$Wb=Wp/1.3=0.77\ Wp$$

$$Wc=0.5\ Wb=0.39\ Wp$$

If the mattress deflection at region B is minimal—say 15 mm and the lumbar curve of a users spine is about 60 mm then for a mattress of uniform stiffness or elasticity, deflection at region P and region C should be about 15+60 mm=75 mm. Such a deflection will require a spring stiffness Kb of $$(75/15)\times[(1.0/1.3)\times Kp]=385\%\ Kp$$

The spring stiffness Kc at region C should be $$(0.5/1.3)\times Kp=39\%\ Kp$$

In summary, in order to provide optimal support over the region C, B and P the following general variation in spring stiffness would be desirable.

| Upper Torso Kc | Middle Torso Kb | Lower Torso Kp |
|---|---|---|
| 0.4 Kp | 3.8 Kp | Kp |
| Kc | 9.5 Kc | 2.5 Kc |
| 0.1 Kb | Kb | 0.26 Kb |

Such variation in spring stiffness is not usually available in production mattresses. The high cost of producing a mattress with such degrees of variation in stiffness plus the differing height of the end user necessitating different placement of regions C, B and P has prohibited the manufacture and availability of mattresses with such performance characteristics to date.

STATEMENT OF INVENTION

In one aspect the invention provides a bed mattress including an outer casing adapted to house one or a plurality of different supportive materials within said casing in a distinct region wherein said outer casing provides for the ready insertion, removal and/or replacement of one or more of said supportive materials without dismantling said mattress or said casing so as to allow a user to vary the supportive quality of said distinct region of said mattress.

The distinct region or regions may be orientated transversely along the length of the mattress to correspond with the different regions of the users body. In such embodiments, the supportive materials may be inserted through a side wall of the mattress.

The supportive materials may be selected from any suitable products including inner spring segments, foam, latex, padding, rolled cotton, loose filling, water bladder sections etc.

The outer casing provides the necessary housing for assembling the selection of supportive materials and may be formed of foam or soft fabric, having side edges, top and bottom edges and a top and bottom face.

Ports in the outer casing may provide access to regions of the mattress to allow modification of the in situ supporting material to increase or decrease local areas of stiffness.

In another aspect the invention provides a bed mattress including an outer casing adapted to house one or a plurality of different supportive materials within said casing in distinct transverse regions wherein fixed supportive materials are provided at the top and bottom regions of said mattress corresponding to the head and foot regions of a user; and an intermediate region so formed between is provided with a transverse array of fixed supportive materials having vacant regions between adjacent materials, wherein said outer casing has a plurality of ports corresponding to said vacant regions which are adapted to facilitate the ready insertion, removal and/or replacement of one or more auxiliary supportive materials so as to allow the user to vary the supportive quality of said intermediate region of said mattress.

The array of fixed supporting means may be a bank of inner springs formed in transverse rows, although any suitable supportive materials can be used.

The intermediate zone may be bordered by a foam edge having slot openings or apertures corresponding to the vacant spaces between rows to receive the supportive materials which can be slid in between said rows to provide additional support to the said intermediate zone.

The outer casing of the mattress may be provided with port openings on the side edges thereof corresponding to said intermediate zone.

The invention will be described in greater detail with reference to the following figures.

DETAILED DESCRIPTION OF THE INVENTION

The invention will now be described with reference to two particular embodiments as detailed in FIGS. 1 to 6.

Figure 1:
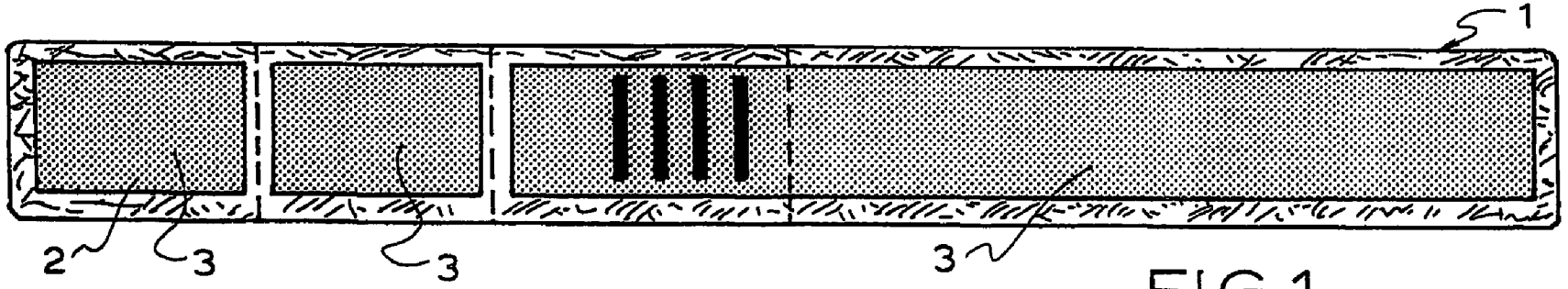
FIG. 1 shows a longitudinal cross-sectional view of the improved bed mattress.

Referring firstly to FIG. 1, the improved bed mattress of the invention can be seen to include an outer casing 1 formed of a compliant and suitably tactile material. The outer casing takes the form and dimensions of a standard mattress including single, double, queen or king. The outer casing has two side edges, a top edge, bottom edge and top and bottom faces. The casing includes an internal volume 2 adapted to receive one or more supporting materials 3. The supporting materials form the foundation of the mattress. The particular features and provisions of the invention provide for a plurality of supporting materials to be housed in the single casing 1 so as to form distinctive regions, but which function as an integrated mattress.

Figure 2:
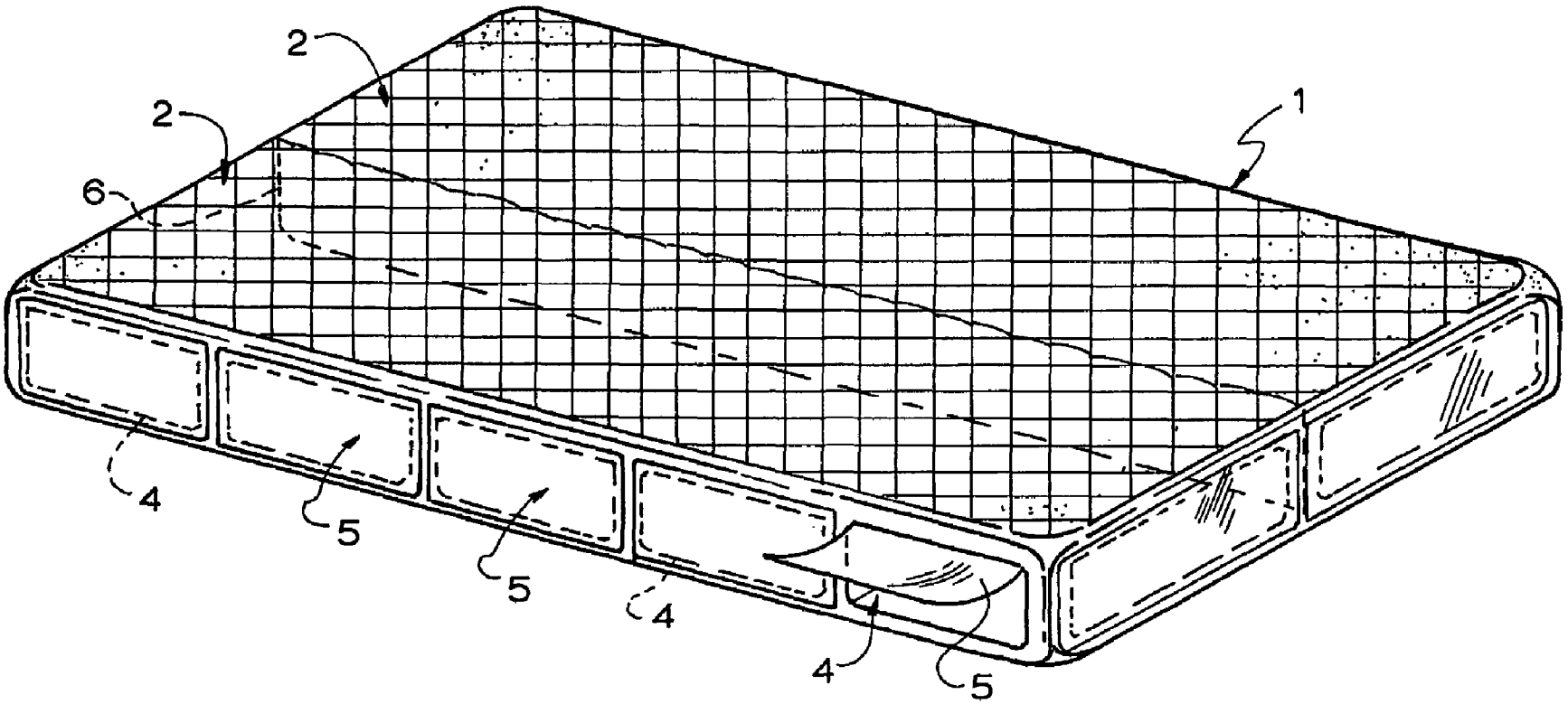
FIG. 2 shows a schematic perspective view of the mattress.

Referring now to FIG. 2, the supporting materials are selected with varying and appropriate degrees of stiffness and resilience to suitably support the various regions of the users body. The outer casing 1 is provided with ports 4 and cover sections 5 so as to provide access to the internal volume 2 to enable the insertion and interchanging of various supporting materials within the internal volume 2 of the mattress. The particular features of the invention allow for the ready mixing and juxtapositioning of a number of supporting materials which can be drawn from inner spring mattress sections, solid or cellfoam, rubber or any of the type of supporting materials currently available. The outer casing 1 may be provided with a central longitudinal divider 6 where the mattress is to be used for dual occupancy.

In the case of dual occupancy, ports can be provided at either end of the outer casing to allow ready insertion of pre configured supporting materials. Alternatively, supporting material regions can be built up by side access.

The outer case may also provide a fully integrated hybrid mattress having smooth transition between the various interfaces.

In use, the invention allows a mattress to be made up with discreet zonings or regions to provide adequate or dedicated optimal support over the Regions C, B and P of a user's body as previously described.

The invention provides for the first time, the ability to compose an "ideal" mattress which takes into full account the different heights and physical attributes of the user.

People of different height will lie on a bed with their head on the pillow which is generally placed at the head of the bed. The head requires a certain amount of support; from there, the upper torso Region C requires a support material of low stiffness which allows the relatively low mass of the upper torso to sink into a soft region of the mattress. The middle torso Section B generally requires a stiffer type of support to counteract the weight of the lower torso Region P. Such additional stiffening can be provided by auxiliary inserts 10 in the form of high density foam bars which can be inserted through one of the ports 4 to reinforce and increase the stiffness of the middle torso Region B to counteract the weight and distortion caused by the lower torso Region P.

EXAMPLE ONE

Figure 3:
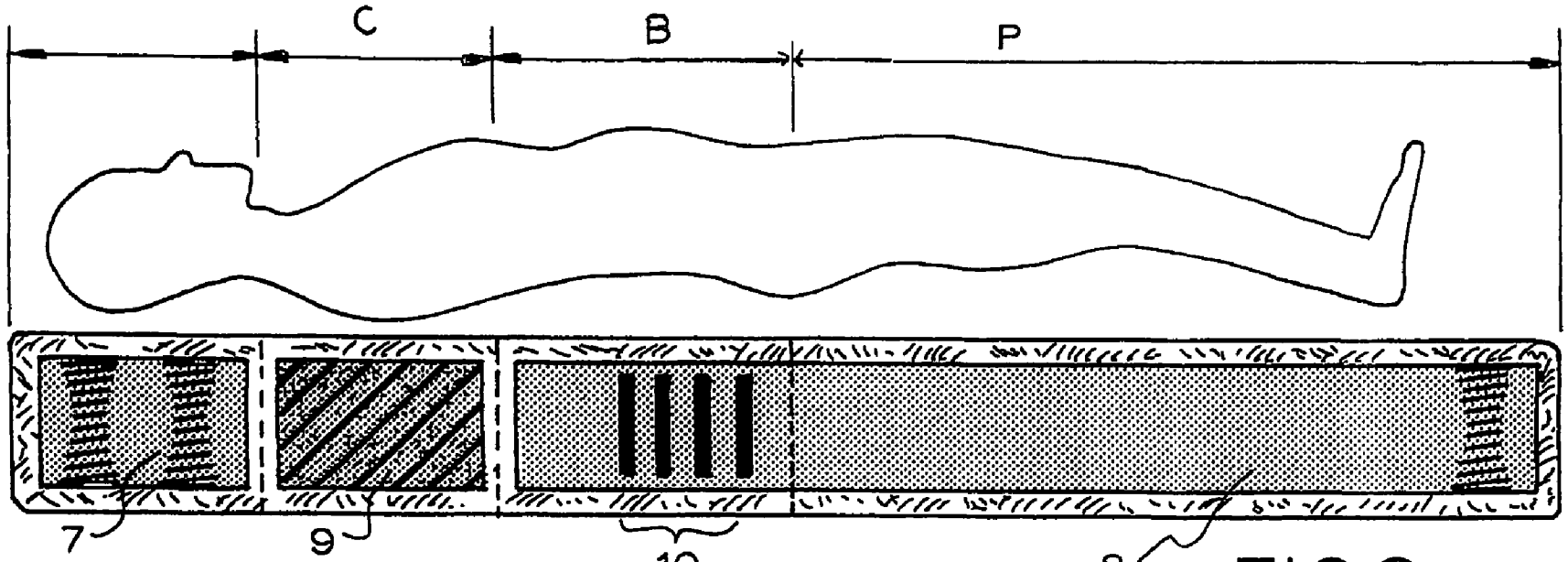
FIG. 3 shows one example of the improved bed mattress.

Referring to FIG. 3, one particularly preferred embodiment of the invention includes the use of standard inner spring mattress support materials (having transverse rows of springs) in regions 7 and 8. In region 9, a foam or latex rubber support is used. The stiffness of regions 7 and 8 is selected as 1 Kp and the stiffness of region 9 is selected as 0.4 Kp or preferably in the range of 0.3-0.95 Kp. In order to locally stiffen up the lumbar region a number of high density foam strips are inserted transversely through the rows of springs in order to increase the stiffness of region 8 at the area required to provide lumbar support.

Of course, if the stiffness of the supporting materials in regions 7 and 9 require alteration, the mattress of the invention allows ready access to those zones via the appropriate port in the side edge of the casing.

EXAMPLE TWO

Figure 4:
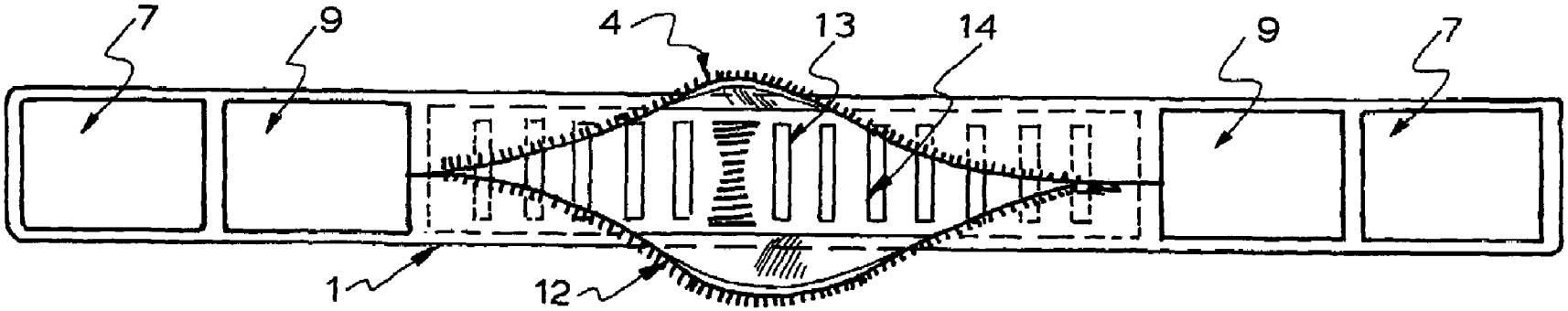
FIG. 4 shows a second embodiment of the invention.
Figure 5:
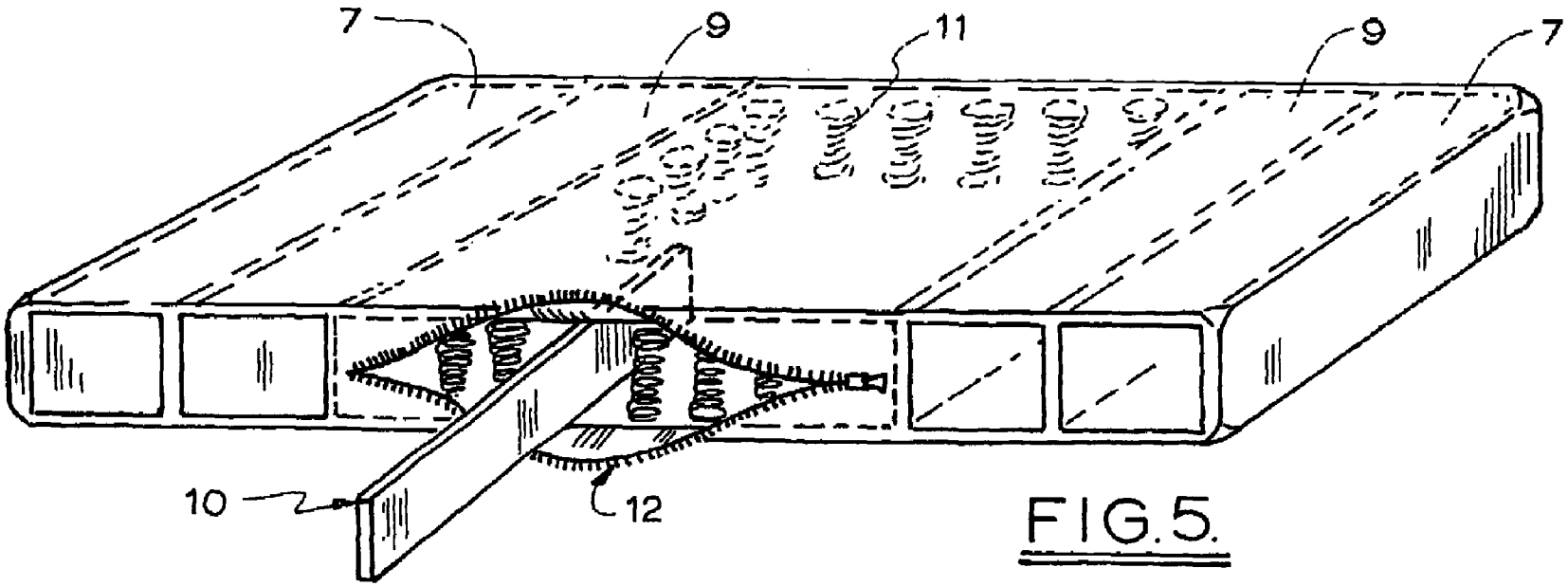
FIG. 5 shows the intermediate section of the mattress.
Figure 6:
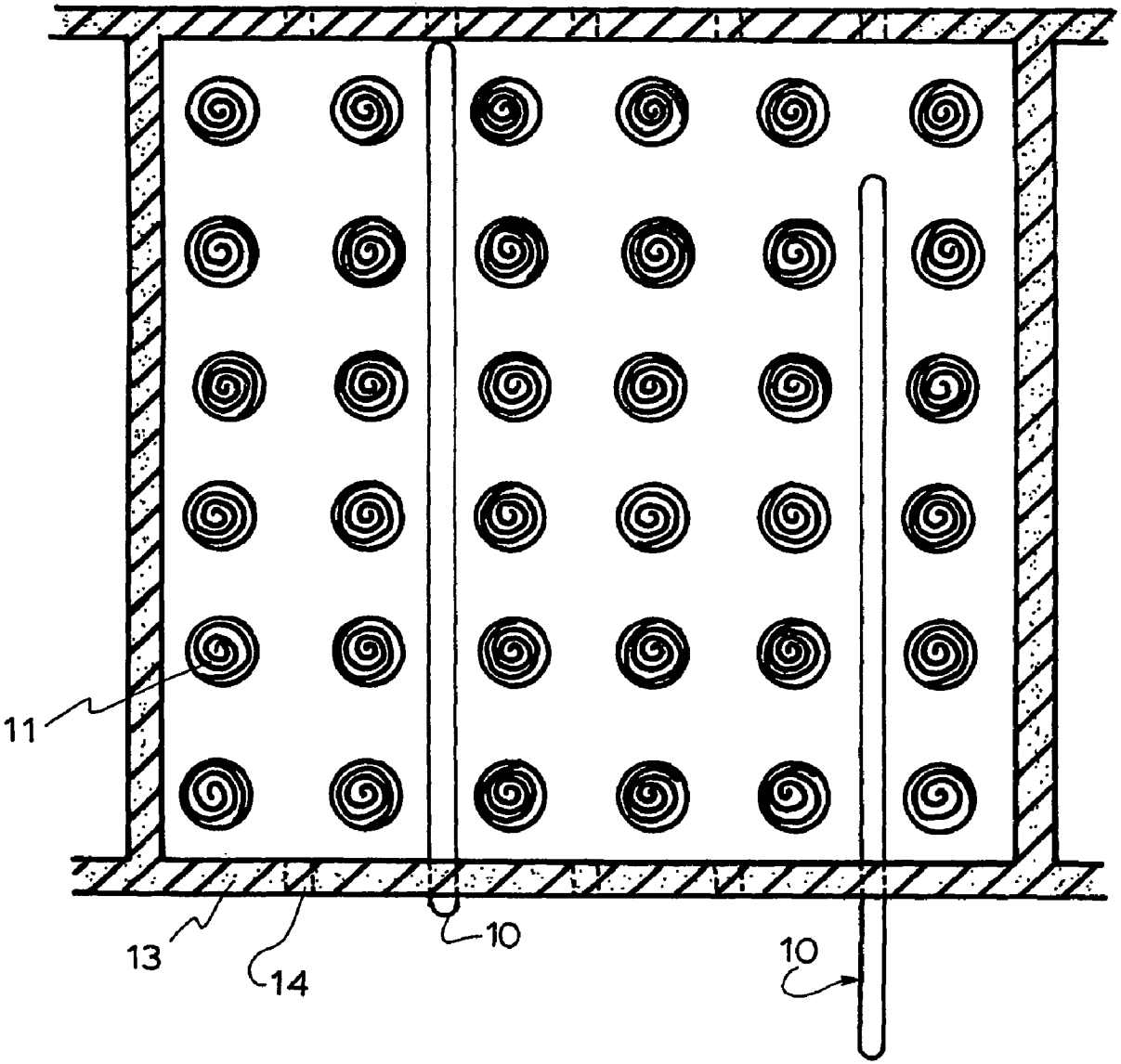
FIG. 6 shows detail of the intermediate section.

In a particularly preferred embodiment of the invention the bed mattress is formed with porting provisions only in the central or lumber region of the mattress and supporting materials 7 and 9 are permanently incorporated at the head and foot regions. FIGS. 4 to 6 show one example of this particular embodiment of the invention where the port region 4 is positioned mid-way along the mattress unit with the outer casing 1 being provided with a port opening 4 mid-way along either side edge thereof which can be opened and closed for ready and immediate access by the zip 12 which could, of course, be replaced by other closure means. The particular embodiment of the invention would be supplied with a selection of supporting materials 7 and 9 in accordance with the users requirements and the central region could be fitted with supporting material in the form of a cage of inner springs 11 fitted within a foam housing 13 such that the individual rows of springs 14 are positioned to correspond with port openings 4 in the foam housing such that auxiliary supporting material in the form of stiffening bars 10 can be readily inserted into the cage 11 to provide ready tailoring of the support provided in this critical region of the mattress. Referring now to FIG. 5, the mattress can be seen to comprise fixed regions of supporting materials 7 and 9 at either end with the supporting materials 9 forming a "softer shoulder zone" traversing most of the mattress. The support material for this "C" zone would most preferably have a compression/weight rating Kc being in the range of perhaps 0.95 to 0.3Kp. The intermediate zone has a "scaled down" version of an inner spring mattress in the form of the spring cage 11 which is formed of a plurality of springs formed in rows such that the gaps between the rows correspond to the openings 14 in the foam cage thereby allowing ready insertion and removal or adjustment of the stiffening bars 10. Alternatively, as shown in FIG. 5, openings 14 may be omitted such that the rows of springs themselves define positions into which the stiffening bars 10 may be inserted. The stiffening bars would be provided in a range of stiffnesses and heights such that a wide range and variety of personalised adjustment can be effected by the user of the mattress of the invention without major disruption to the structure of the mattress. It is even possible with the mattress of the invention to effect adjustment of the support without having to undo or remove bedding from the mattress. All that is required is to lift up the bedding from one side, undo the zip or closure 12 and adjust the stiffening bars 10 as required.

The particular advantages of this embodiment of the invention include the elimination of the need to provide minimal support to the region 7 and 9 of the mattress which would be required if the whole mattress were to be adjustable in order to allow for the lowest support denominator which can be adjusted up in stiffness. The most important region of the mattress requiring adjustment is the lumbar region and accordingly, with this embodiment of the invention, the supporting region 7 and 9 can be provided with a limited range of stiffnesses catering for the range of requirements for the user, or may be omitted altogether, and only the important lumbar region need be provided with the lower range of stiffness which is adjustable by the provision of the stiffening bars 10. Furthermore, in order to provide full access to the range of stiffnesses provided over the mattress, the outer casing 1 of this embodiment of the invention is preferably of particularly compliant and soft material allowing maximum transparency of feel and stiffness to the internal mattress structure. Of course if the requirements of the user dictate a softer lumber and firmer shoulder regions, the invention can readily provide such a configuration.

In use, the user would lie on the mattress causing the lower torso region to distort to the greatest degree. The stiffening bars 10 will prevent the adjacent lumbar region responding and provide the necessary support. The upper torso region 9 will allow the light area of the body to sink into the mattress thereby maintaining the overall shape of the user's body while providing full support over the length of the mattress.

The ability of the current invention to provide for the mosaicing of various supporting materials of different stiffness and the ability of the mattress to provide ready access for tailoring those regions by the provision of stiffening bars etc allows for the first time, a commercially viable mattress which can be mass produced as a general mattress and specifically tailored to accommodate the various regions of the body by providing dedicated supporting means for the disparate regions C, B and P of the user's body. The invention provides for the first time a mattress that can provide a practical solution by having the "weight contours" of a user much more closely approximated to the "shape contours" of the user in order to provide optimal support for that user on the mattress.

It will be appreciated by persons skilled in the art that numerous variations and/or modifications may be made to the invention as shown in the specific embodiments without departing from the spirit or scope of the invention as broadly described. The present embodiments are, therefore, to be considered in all respects as illustrative and not restrictive.

The invention claimed is:

1. A bed mattress, comprising:

an outer casing having a sleeping surface and at least first, second, and third sections, the third section being located between the first and second sections so that, when a user lays down on the mattress, the user's head is adjacent the first section of the outer casing, the user's feet are adjacent the second section of the outer casing, and the user's torso is adjacent the third section of the outer casing;

the outer casing further having a plurality of fixed coil spring supports contained therein, a first set of the fixed coil spring supports being located in the first section of the outer casing, a second set of the fixed coil spring supports being located in the second section of the outer casing, and a third set of the fixed coil spring supports being located in the third section of the outer casing so that, when the user lays down on the sleeping surface, head, feet, and torso portions of the user's body are disposed above the first, second and third sets of the fixed coil spring supports, respectively;

wherein the first and second sets of fixed coil spring supports provide a non-modifiable degree of support to the head and feet portions of the user's body, respectively, when the user lays down on the mattress;

wherein the third section of the outer casing includes at least one cover section being attached to and defining at least a portion of a side surface of the third section of the outer casing, the side surface being generally perpendicular to the sleeping surface of the third section of the outer casing;

wherein the at least one cover section of the third section of the outer casing is capable of being opened to provide for the ready insertion, removal and/or replacement of auxiliary supportive materials between adjacent rows of the third set of fixed coil spring supports without dismantling the mattress, the auxiliary supportive materials being different than the fixed coil spring supports; and wherein the auxiliary supportive materials are arranged with respect to the third set of fixed coil spring supports so that the sleeping surface of the third section of the outer casing provides a user-selected degree of support to the torso portion of the user's body when the user lays down on the mattress.

2. The mattress of claim 1, wherein the outer casing is compliant.

3. The mattress of claim 1, wherein the stiffness of at least part of the third section of the outer casing above the third set of the fixed coil springs is between about 0.1 Kp and about 0.9 Kp.

4. The mattress of claim 1, wherein the stiffness of at least part of the third section of the outer casing above the third set of the fixed coil springs is greater than or equal to about 1.15 Kp.

5. The mattress of claim 1, wherein the auxiliary supportive materials are selected from any one of a combination of materials including foam, latex, padding, rolled cotton, loose filing and water bladders.

6. The mattress of claim 1, wherein the stiffness of at least part of the third section of the outer casing above the third set of fixed coil spring supports is less than about 0.95 Kp.

* * * * *